US009218952B2

(12) United States Patent
Nittke et al.

(10) Patent No.: US 9,218,952 B2
(45) Date of Patent: Dec. 22, 2015

(54) ELECTRIC LAMP INCLUDING A BUILT-IN-LAMP HAVING A PINCH SEAL

(71) Applicant: OSRAM GmbH, Munich (DE)

(72) Inventors: Andreas Nittke, Adelschlag OT Pietenfeld (DE); Roland Stark, Wellheim (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/526,553

(22) Filed: Oct. 29, 2014

(65) Prior Publication Data

US 2015/0145407 A1 May 28, 2015

(30) Foreign Application Priority Data

Nov. 22, 2013 (DE) ..... 10 2013 223 904

(51) Int. Cl.

| | |
|---|---|
| ***H01K 1/50*** | (2006.01) |
| ***H01K 1/14*** | (2006.01) |
| ***H01K 1/38*** | (2006.01) |
| ***H01K 1/18*** | (2006.01) |

(52) U.S. Cl.
CPC ... *H01K 1/38* (2013.01); *H01K 1/18* (2013.01)

(58) Field of Classification Search
CPC ..... H01K 1/38; H01K 1/18
USPC ..... 313/578
See application file for complete search history.

(56) References Cited

U.S. PATENT DOCUMENTS

| | | | |
|---|---|---|---|
| 4,316,240 | A | 2/1982 | Pitkjaan et al. |
| 2010/0253205 | A1 | 10/2010 | Stark et al. |
| 2011/0241530 | A1 | 10/2011 | Korndoerfer et al. |
| 2012/0274199 | A1 | 11/2012 | Becht et al. |

FOREIGN PATENT DOCUMENTS

| | | | |
|---|---|---|---|
| AU | 2010201342 | A1 | 10/2010 |
| DE | 202009005396 | U1 | 8/2009 |
| DE | 102008028383 | A1 | 12/2009 |
| DE | 202008016865 | U1 | 3/2010 |
| EP | 2337061 | A1 | 6/2011 |
| EP | 2518754 | A2 | 10/2012 |
| WO | 2009150063 | A1 | 12/2009 |

OTHER PUBLICATIONS

German Search Report issued on Mar. 25, 2014 in the German priority application No. 10 2013 223 904.1.

*Primary Examiner* — Joseph L Williams
(74) *Attorney, Agent, or Firm* — Viering, Jentschura & Partner; Karl Kolbinger

(57) ABSTRACT

An electric lamp having a longitudinal axis is provided. The electric lamp may include a base; and a built-in lamp, which has a pinch seal. Two power supply lines protrude out of the pinch seal. Two pins for connection to the power supply lines are provided on the base side. In each case one pin and one power supply line are connected by means of a mounting clip. A mounting clip is a punched sheet-metal part having a bottom which is configured so as to be substantially rectangular with a width B and a length L. Two spring arms are attached to the bottom, which spring arms surround the pinch seal of the built-in lamp. In each case one means for fastening a pin and one means for fastening a power supply line are provided on the mounting clip.

18 Claims, 5 Drawing Sheets

ELECTRIC LAMP INCLUDING A BUILT-IN-LAMP HAVING A PINCH SEAL

CROSS-REFERENCE TO RELATED APPLICATION

This application claims priority to German Patent Application Serial No. 10 2013 223 904.1, which was filed Nov. 22, 2013, and is incorporated herein by reference in its entirety.

TECHNICAL FIELD

Various embodiments relate generally to an electric lamp.

BACKGROUND

Such lamps are in particular halogen incandescent lamps having a built-in lamp or else so-called retrofit lamps. They are conceived in particular for operation on a medium voltage (MV) to a high voltage (HV) of typically 80 to 250 V.

EP 2 337 061 has disclosed halogen incandescent lamps in which a light source for a halogen incandescent lamp is a built-in lamp, which is adjusted in an outer bulb by means of a frame.

In this case, the frame is complex insofar as it additionally requires a clip or at least one additional holding rod.

SUMMARY

An electric lamp having a longitudinal axis is provided. The electric lamp may include a base; and a built-in lamp, which has a pinch seal. Two power supply lines protrude out of the pinch seal. Two pins for connection to the power supply lines are provided on the base side. In each case one pin and one power supply line are connected by means of a mounting clip. A mounting clip is a punched sheet-metal part having a bottom which is configured so as to be substantially rectangular with a width B and a length L. Two spring arms are attached to the bottom, which spring arms surround the pinch seal of the built-in lamp. In each case one means for fastening a pin and one means for fastening a power supply line are provided on the mounting clip.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Figure 1:
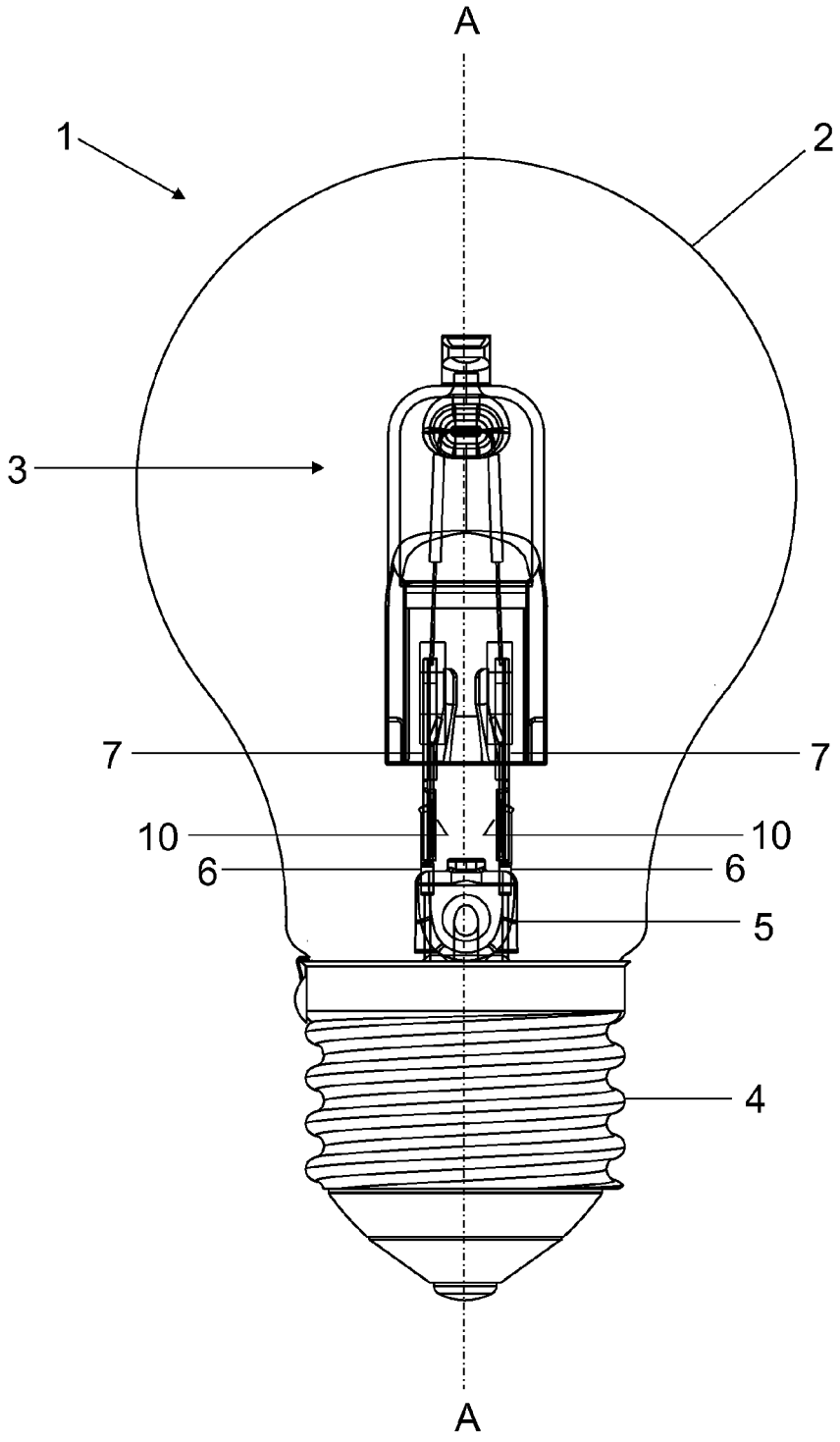
FIG. 1 shows a front view of a halogen incandescent lamp.

An embodiment of a halogen incandescent lamp 1 is shown in FIG. 1. In this case, the lamp has an outer bulb 2, in which a built-in lamp 3 is accommodated. The halogen incandescent lamp also has a base 4 and a plate-like stand 5, as this concept is known fundamentally per se.

Two base pins 6, which are each mechanically fixedly and electrically conductively connected to power supply lines 7 via a mounting clip 10, which power supply lines protrude downwards out of a pinch seal 8 of the built-in lamp, protrude out of the plate-like stand 5.

Figure 2:
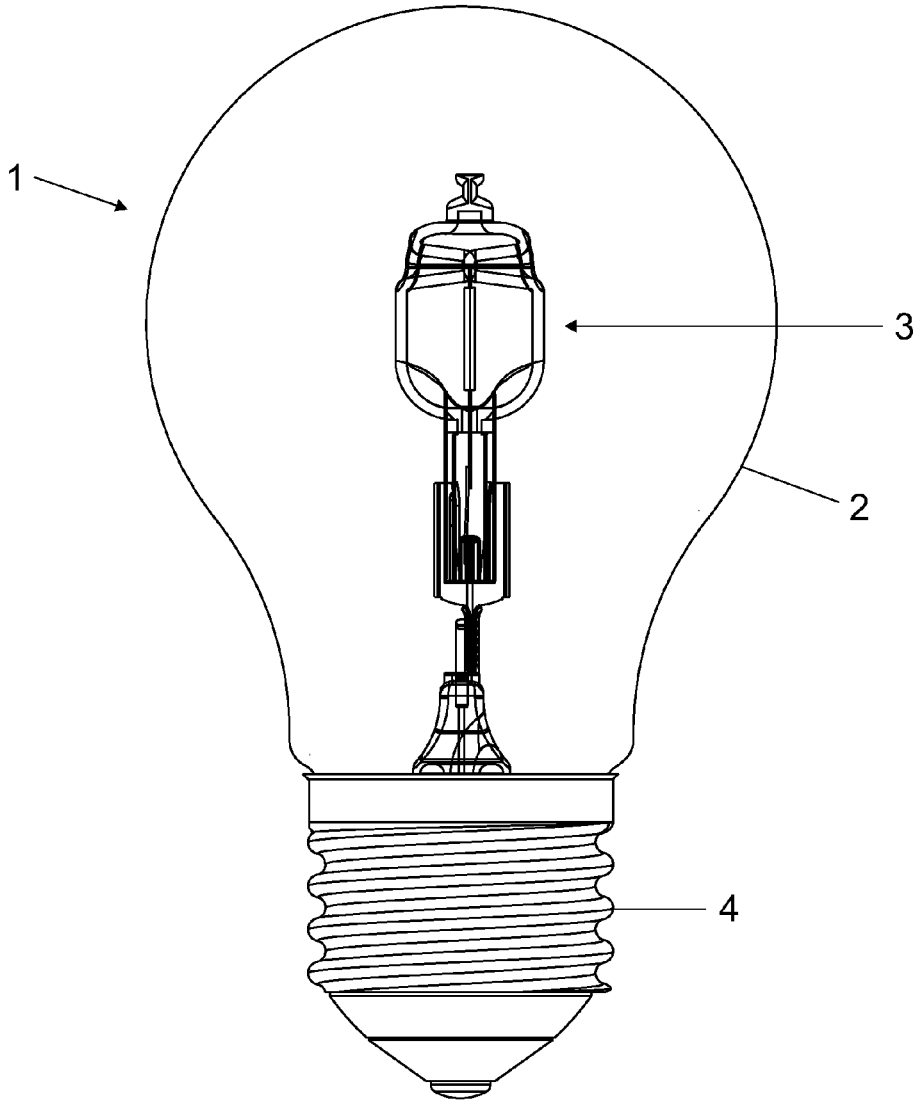
FIG. 2 shows a view rotated through 90° of a halogen incandescent lamp.

FIG. 2 shows the lamp 1 in a view rotated through 90°.

Figure 3A:
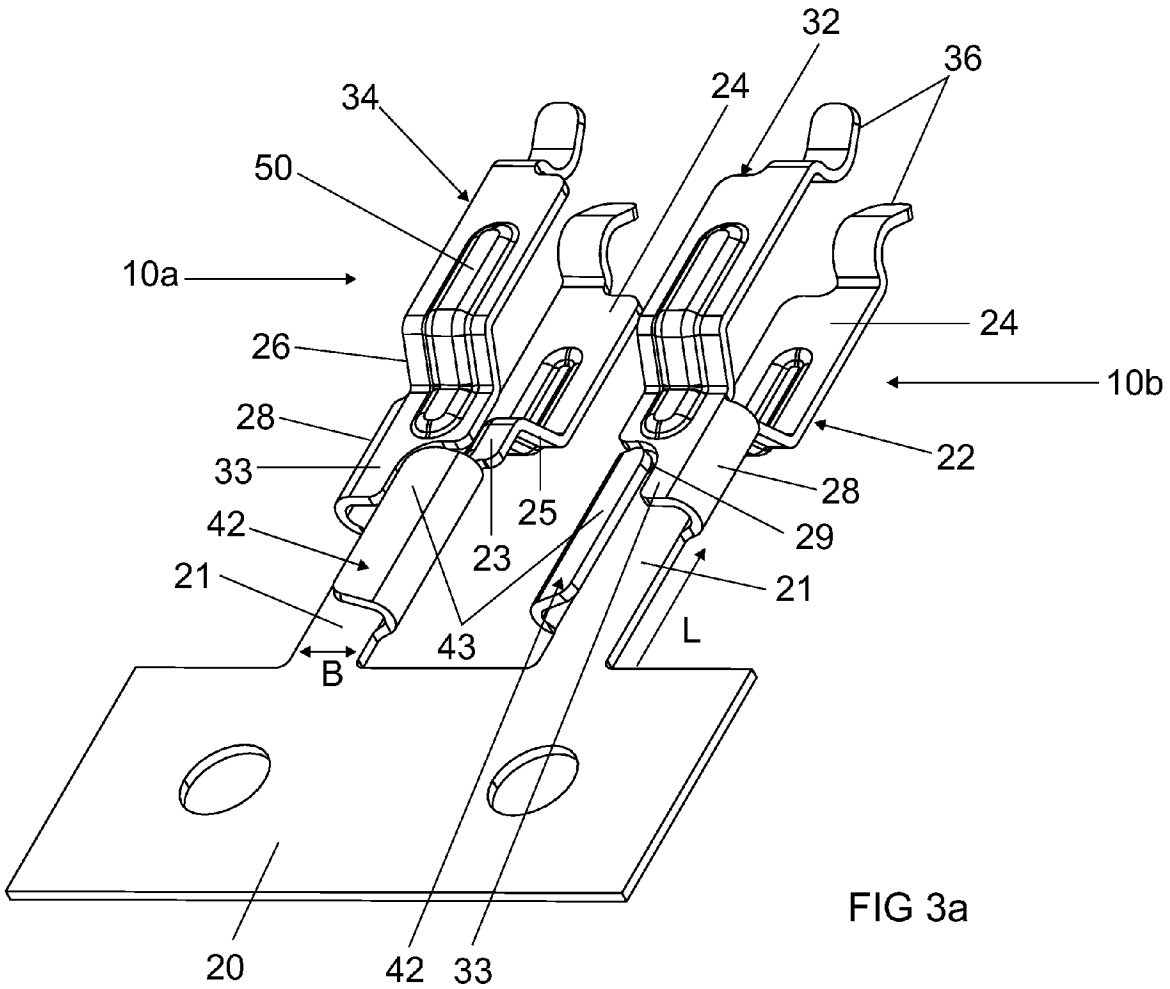
FIGS. 3A, 3B, and 3C shows a detail view of the mounting clip in perspective, in a side view and in section.
Figure 3B:
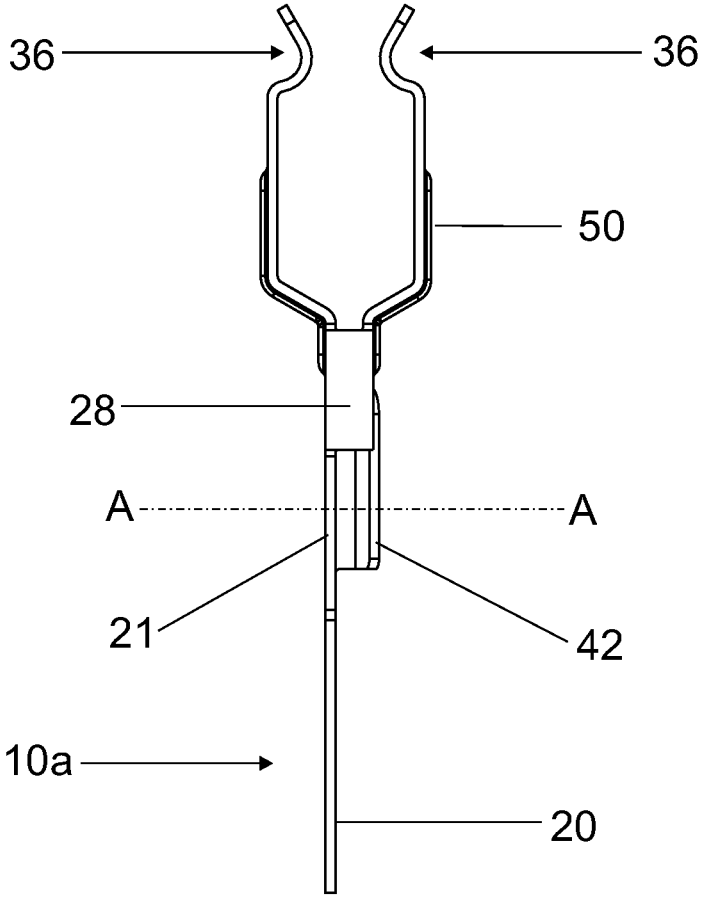
Figure 3C:
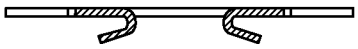

FIG. 3 shows a detail of a punched sheet-metal strip 20, from which a pair of mounting clips 10*a* and 10*b* have already been cut out and bent functionally, wherein the pair are in principle configured and shaped so as to be mirror-symmetrical with respect to one another.

In each case one bottom part 21, which substantially represents a rectangle, protrudes laterally out of the strip 20 in the plane of the strip. It has a predetermined width B and length L. The values of said width and length result from the dimensions of the lamp and parts thereof, e.g. also from the thickness of the pins and power supply lines and the type of built-in lamp. A first spring arm 22 is attached integrally to the bottom part 21, to be precise at the top end. The first spring arm 22 has two sections. A first section 23 lies in the plane of the bottom part, but usually has a different width. A second section 24 is attached at the top to the first section 23, to be precise via an angled connecting piece 25 by means of bending, with the result that this second section 24 lies in a second plane parallel to the bottom 21.

A second spring arm 32 is attached to the bottom 21 via a connecting piece 28. The connecting piece 28 rests laterally at the top on a first longitudinal side of the bottom 21. This connecting piece is bent back in the form of a U, to be precise in a direction which is opposite the direction of the second plane, into a third parallel plane. The first section 33 of the second spring arm lies in this plane, which first section can also have cutouts 29 in order to save on material, or else in order to avoid any overlaps, as explained below. A second section 34 of the second spring arm is attached to the first section 33 at the top, to be precise via a further connecting piece 26 by means of bending, with the result that this second section 34 lies in a parallel fourth plane, and wherein the second section of the second spring arm is precisely opposite the second section of the first spring arm. The first sections of the two spring arms are also opposite one another.

The two second sections 24, 34 of the two spring arms each have a corrugated spring tongue 36 at the top end. The corrugation points inwards, i.e. towards one another.

In this case, the spacing between the first and third planes is selected precisely such that it is matched to the thickness of the power supply line 7 of the built-in lamp with play, with the result that the power supply line 7 can be fitted as into a U-shaped profile there, which takes place from the top.

In addition, the spacing between the spring tongues 36 is selected precisely such that it is matched to the thickness of the pinch seal 40 of the built-in lamp, with the result that the built-in lamp can be held and fixed on the pinch seal 40 by means of a pair of mounting clips 10*a*, 10*b*.

The two spring arms may be stabilized by reinforcing ribs 50.

In addition, a receptacle-like extension part 42 is attached to the bottom part 21 laterally on the second side rim, which extension part forms a U-shaped profile in order to receive a base pin 6. For this purpose, a plate-like protrusion 43 is bent back laterally through 180° on the bottom. The direction of the angling is selected e.g. such that it corresponds to the direction for the second spring arm. Therefore, it may be advantageous if the plate-like protrusion 43 is attached approximately in the center of the second side rim of the bottom part. It may be advantageous for secure holding and contact-making of the base pin 6 if the protrusion 43 is as long as possible, e.g. having a length of approximately 60 to 90% of the length of the bottom. Since protrusion 43 and second spring arm 32 would get physically in each others way since they do protrude out of opposite side edges but are bent back in the same direction, it may be advantageous if the second spring arm has a corresponding cutout 29 in the region of its first section, which cutout leaves space for the protrusion 43.

Figure 4:
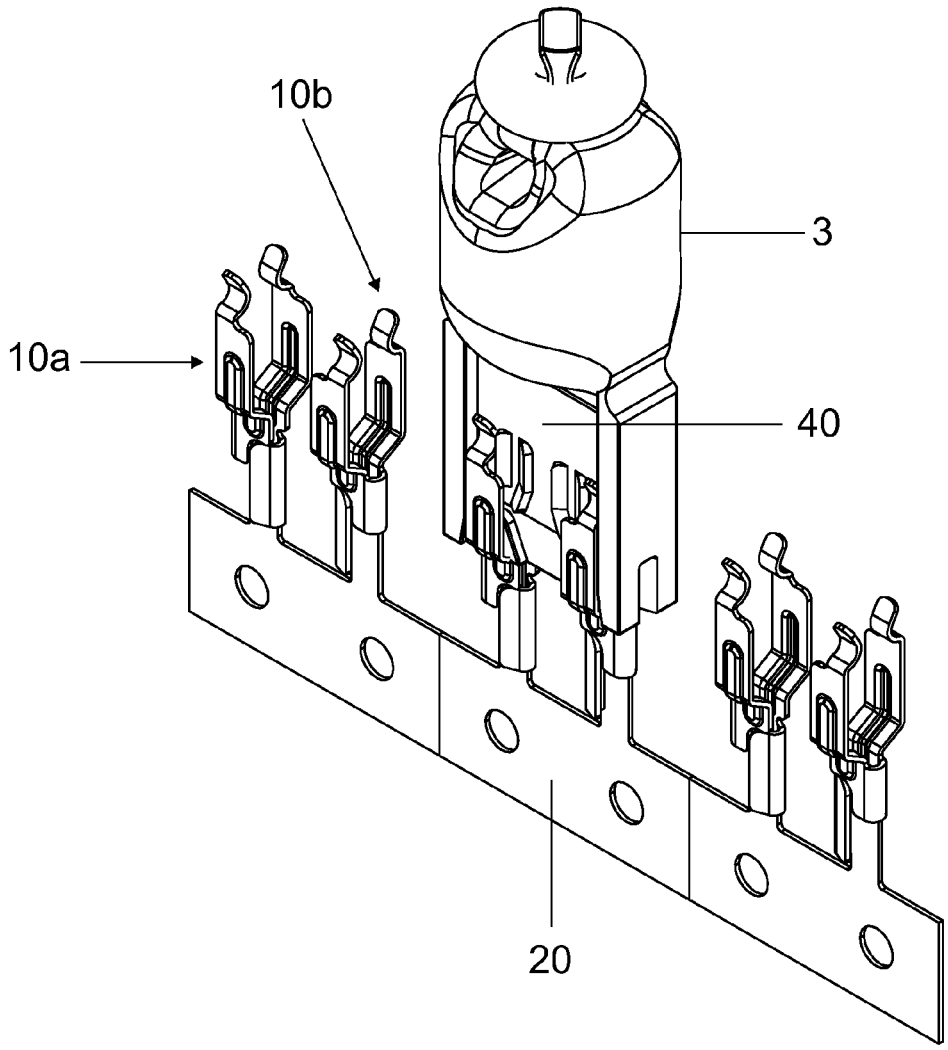
FIG. 4 shows an illustration of a built-in lamp comprising two attached mounting clips prior to separation of the punched sheet-metal strip.

Finally, FIG. 4 shows a built-in lamp 3 after fitting thereof on a pair of mounting clips 10*a*, 10*b*. Only then is the rest of the punched sheet-metal strip 20 separated. A typical thickness for the punched sheet-metal strip is 0.1 to 0.5 mm. In this case, it is firstly necessary to ensure sufficient stability, and secondly to ensure sufficient flexibility and spring action.

Various embodiments provide an electric lamp in which a built-in lamp can be fitted easily.

In the case of halogen incandescent lamps, the light source is often a built-in lamp which is intended to be produced mechanically in as material-saving a manner as possible and in a manner which saves on working steps as much as possible on a fast automated production line.

In accordance with various embodiments, a special mounting clip is now used which is in the form of a fork-like clip and which holds the light source, namely the built-in lamp, directly at the pinch seal, but at the same time adjusts said light source. In this case, it is irrelevant whether the built-in lamp is based on incandescent lamp technology or advanced LED (light emitting diode) technology or else discharge lamp technology.

The mounting clip is a punched sheet-metal part and has, starting from a bottom, the bottom part, a forked region which is formed from two spring arms, which surround a pinch seal of the built-in lamp, wherein in each case one means for fastening a pin and one means for fastening a power supply line are provided on the mounting clip. This is in particular a part which is U-shaped in cross section (U-shaped profile), into which part the Mo pin is crimped. The mounting clip is often characterized below as fork-like clip.

In a further embodiment, the means which is intended to surround the Mo pin can be embodied as an enclosure with latching tabs so that the mounting clip is already fixed by being pushed onto the built-in lamp (without any crimping).

As a further embodiment, welding to the pins on the side of a plate-like stand can likewise be embodied as latching.

With the proposed mounting clip, both built-in lamps with a hard glass bulb and built-in lamps with a quartz glass bulb can be processed.

An effect of various embodiments may consist in that the diameter of the power supply line can now be reduced. Previously, power supply lines with a diameter of typically 1.25 mm were conventional. With the novel fork-like clip, power supply lines with a considerably smaller diameter can be used. In this case, a value of from 0.4 to 0.6 mm may be provided. However, such thin power supply lines do not have sufficient impact resistant, and therefore need to be provided with suitable stabilization in order to increase their bending strength. This may be achieved with the novel fork-like clip.

During manufacture, the built-in lamp is first positioned with its pinch seal into a pair of fork-like clips, whose dimensions are matched in a suitable manner to the pinch seal. The fork-like clips each have two spring arms, between which the pinch seal then comes to lie. These spring arms fix and hold the built-in lamp in the region of the pinch seal.

During positioning of the built-in lamp, the power supply lines are centered on the fork-like clip and are brought into the correct crimping position at the crimping lugs. Then, the crimping lugs of the clips are pressed together by a molding press, with the result that the power supply lines of the built-in lamp are held in a force-fitting manner.

Only then are the clips separated from the punching strip. As a result, it is overall possible for a built-in lamp with power supply lines which have a low bending strength to nevertheless be capable of being welded securely and with a precise fit on a plate-like stand.

In each case one fork-like clip is crimped initially to a thin molybdenum power supply line which protrudes out of the built-in lamp, and only then is this structural unit welded to the power supply line on the side of the plate-like stand, which power supply line protrudes out of the plate-like stand, which later closes the outer bulb.

In various embodiments, the fork-like clip is a punched sheet-metal part, obtained from a punching strip of sheet-metal. The fork-like clip is used in pairs, wherein a pair is configured so as to be in each case mirror-symmetrical to one another. A single fork-like clip has the following components:

A bottom, which virtually represents the reference plane from the strip. It has a leaf-like shape, similar to a rectangle, and has a given width B and a given length L. The ratio of L:B may be 2 to 8, e.g. 3 to 7. Definition: in this context at the top means pointed away from the original strip from which the clip is produced. At the bottom means pointing in the direction of the strip.

At the top, a first spring arm adjoins the bottom directly. The maximum width BF of said first spring arm amy be in a range of from 0.9 to 2 times the value of B, e.g. 1.0 to 1.3 B. Its maximum length LF is approximately 0.5 to 2 times the value of L.

The spring arm is bent so that a section positioned at the bottom is substantially in the plane of the bottom, while an upper section is bent out of this plane into a second plane parallel thereto.

The spring arm may have reinforcing ribs.

The spring arm may have a corrugated spring end, which rests at the top on the second section and points away from the bottom. The corrugation is directed inwards, in the direction of the first plane. The width BW of the corrugation may be notably smaller than BF. It may be e.g. 0.3 to 0.7 BF. The corrugated spring end is that part which fixes the pinch seal of the built-in lamp.

A second, substantially mirror-symmetrical spring arm is opposite the first spring arm. It is obtained from the punched sheet-metal part by virtue of a hump part branching off from the bottom on the top right side. This is a connecting part which is turned outwards through 180°, wherein a punched sheet-metal body part laterally adjoins said connecting part integrally, which punched sheet-metal body part has a configuration which is mirror-symmetrical to the first spring arm.

Therefore, the two spring arms are opposite one another with a certain spacing, which is derived in a suitable manner from the thickness of the pinch seal of the built-in lamp or is matched externally to this thickness.

The actual clamping of the pinch seal is in this case ensured by the two corrugated spring arms.

In addition, another receptacle-like punched sheet-metal part branches off from the bottom on the side which is opposite the branching of the second spring arm. The receptacle-like punched sheet-metal part to a certain extent provides a U-shaped profile which is used for receiving the power supply line out of the plate-like stand.

The power supply line which protrudes downwards out of the pinch seal of the built-in lamp, is introduced into a type of U-shaped profile, which is formed by the bottom part, on the one hand, and the connecting part and lower section of the second spring arm, on the other hand.

The U-shaped profiles are configured in such a way that the respective power supply lines can be inserted with an axial orientation therein and can then be crimped.

It has proven to be advantageous if each spring arm has a threading guide or an inlet for the power supply lines, which are fitted in the region of the reinforcing ribs.

The design of the mounting clip is based on manufacture in the form of a punched sheet-metal part.

Various features of the invention are set forth below in the form of an enumerated list:

1. An electric lamp having a longitudinal axis, e.g. a halogen incandescent lamp, including a base and a built-in lamp, which has a pinch seal, wherein two power supply lines protrude out of the pinch seal, and wherein two pins for connection to the power supply lines are provided on the base side, wherein in each case one pin and one power supply line are connected by means of a mounting clip, wherein a mounting clip is a punched sheet-metal part having a bottom which is configured so as to be substantially rectangular with a width B and a length L, wherein two spring arms are attached to the bottom, which spring arms surround the pinch seal of the built-in lamp, wherein in each case one means for fastening a pin and one means for fastening a power supply line are provided on the mounting clip.

2. The halogen incandescent lamp according to proposal 1, wherein the first spring arm is attached to the bottom directly at the top and is bent so as to point outwards.

3. The halogen incandescent lamp according to proposal 1, wherein the second spring arm is attached to the bottom via a connecting part, which rests laterally on the bottom and is angled, and said second spring arm is configured and shaped in such a way that it has a configuration and shape which is substantially mirror-inverted with respect to the first spring arm and is opposite said first spring arm.

4. The halogen incandescent lamp according to proposal 1, wherein the spring arms have reinforcing ribs.

5. The halogen incandescent lamp according to proposal 4, wherein the spring arms are assembled from two sections, wherein a first section of the first spring part lies in the plane of the bottom, while the second section of the first spring part is moved from the first plane into a second plane via a right-angled bend.

6. The halogen incandescent lamp according to proposal 4, wherein the connecting part forms a first U-shaped profile.

7. The halogen incandescent lamp according to proposal 1, wherein a receptacle-like extension part is attached laterally to the bottom, as means for receiving a pin.

8. The halogen incandescent lamp according to proposal 2, wherein the means for receiving a power supply line is formed by a U-shaped profile, which is formed by the connecting part being bent back and the first section, attached thereto, of the second spring arm together with the bottom part.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electric lamp having a longitudinal axis, the electric lamp comprising:

a base; and a built-in lamp, which has a pinch seal;

wherein two power supply lines protrude out of the pinch seal; and wherein two pins for connection to the power supply lines are provided on the base side;

wherein in each case one pin and one power supply line are connected by means of a mounting clip;

wherein a mounting clip is a punched sheet-metal part having a bottom which is configured so as to be substantially rectangular with a width B and a length L;

wherein two spring arms are attached to the bottom, which spring arms surround the pinch seal of the built-in lamp;

wherein in each case one means for fastening a pin and one means for fastening a power supply line are provided on the mounting clip.

2. The electric lamp of claim 1, configured as a halogen incandescent lamp.

3. The lamp as claimed in claim 1, wherein the first spring arm is attached to the bottom directly at the top and is bent so as to point outwards.

4. The lamp as claimed in claim 1, wherein the second spring arm is attached to the bottom via a connecting part, which rests laterally on the bottom and is angled, and said second spring arm is configured and shaped in such a way that it has a configuration and shape which is substantially mirror-inverted with respect to the first spring arm and is opposite said first spring arm.

5. The lamp as claimed in claim 1, wherein the spring arms have reinforcing ribs.

6. The lamp as claimed in claim 1, wherein the spring arms are assembled from two sections;

wherein a first section of the first spring part lies in the plane of the bottom, while the second section of the first spring part is moved from the first plane into a second plane via a right-angled bend.

7. The lamp as claimed in claim 1, wherein the connecting part forms a first U-shaped profile.

8. The lamp as claimed in claim 1, wherein a receptacle-like extension part is attached laterally to the bottom, as means for receiving a pin.

9. The lamp as claimed in claim 3, wherein the means for receiving a power supply line is formed by a U-shaped profile, which is formed by the connecting part being bent back and the first section, attached thereto, of the second spring arm together with the bottom part.

10. An electric lamp having a longitudinal axis, the electric lamp comprising:

a base; and a built-in lamp having a pinch seal;

two power supply lines protruding out of the pinch seal; and two pins connected to the power supply lines on the base side;

wherein in each case one pin and one power supply line are connected by means of a mounting clip;

wherein a mounting clip is a punched sheet-metal part having a bottom which is configured so as to be substantially rectangular;

wherein two spring arms are attached to the bottom, wherein the spring arms surround the pinch seal of the built-in lamp;

wherein in each case a fastener configured to fasten a pin and to fasten a power supply line is provided on the mounting clip.

11. The electric lamp of claim 10, configured as a halogen incandescent lamp.

12. The lamp as claimed in claim 10, wherein the first spring arm is attached to the bottom directly at the top and is bent so as to point outwards.

13. The lamp as claimed in claim 10, wherein the second spring arm is attached to the bottom via a connecting part, which rests laterally on the bottom and is angled, and said second spring arm is configured and shaped in such a way that it has a configuration and shape which is substantially mirror-inverted with respect to the first spring arm and is opposite said first spring arm.

14. The lamp as claimed in claim 10, wherein the spring arms have reinforcing ribs.

15. The lamp as claimed in claim 10, wherein the spring arms are assembled from two sections;

wherein a first section of the first spring part lies in the plane of the bottom, while the second section of the first spring part is moved from the first plane into a second plane via a right-angled bend.

16. The lamp as claimed in claim 10, wherein the connecting part forms a first U-shaped profile.

17. The lamp as claimed in claim 10, wherein a receptacle-like extension part is attached laterally to the bottom to receive a pin.

18. The lamp as claimed in claim 12, wherein the means for receiving a power supply line is formed by a U-shaped profile, which is formed by the connecting part being bent back and the first section, attached thereto, of the second spring arm together with the bottom part.

* * * * *